US006085144A

United States Patent [19]

Tozzi

[11] Patent Number: 6,085,144

[45] Date of Patent: Jul. 4, 2000

[54] APPARATUS AND METHOD FOR DIAGNOSING AND CONTROLLING AN IGNITION SYSTEM OF AN INTERNAL COMBUSTION ENGINE

[75] Inventor: Luigi P. Tozzi, Columbus, Ind.

[73] Assignee: Cummins Engine Company, Inc., Columbus, Ind.

[21] Appl. No.: 09/298,817

[22] Filed: Apr. 23, 1999

Related U.S. Application Data

[62] Division of application No. 08/988,787, Dec. 11, 1997, Pat. No. 6,006,156.

[51] Int. Cl.[7] ..... F02P 17/12; F02P 11/00

[52] U.S. Cl. ..... 701/114; 701/102; 324/399

[58] Field of Search ..... 701/101, 114, 701/102; 324/399, 378, 380; 123/653, 593

[56] References Cited

U.S. PATENT DOCUMENTS

| | | | |
|---|---|---|---|
| 4,291,383 | 9/1981 | Tedeschi et al. | 701/102 |
| 4,558,280 | 12/1985 | Koehl et al. | 324/399 |
| 5,334,938 | 8/1994 | Kugler et al. | 324/399 |
| 5,399,972 | 3/1995 | Hnat et al. | 324/399 |
| 5,821,754 | 10/1998 | Puettmann et al. | 324/388 |
| 6,006,156 | 12/1999 | Tozzi | 701/114 |

*Primary Examiner*—Henry C. Yuen
*Assistant Examiner*—Hieu T. Vo
*Attorney, Agent, or Firm*—Baker & Daniels

[57] ABSTRACT

An apparatus for diagnosing and controlling an ignition system of an internal combustion engine includes an ignition coil controllable by an ignition control circuit, a spark voltage sensor electrically connected to the high tension side of the ignition coil secondary and an ion voltage sensor electrically connected to the low tension side of the ignition coil secondary. A computer processes the spark voltage signal by comparing the signal to a number of predefined spark voltage waveforms in memory. If the spark voltage signal matches any of the spark voltage waveforms in memory that correspond to a predefined ignition system failure mode, a corresponding error code is stored in memory. The computer is further operable to process a voltage peak of the spark voltage, wherein the voltage peak corresponds to the breakdown voltage in the spark gap of a spark plug connected to the secondary coil. If the voltage peak exceeds a peak threshold, or if a slope of the spark voltage waveform about the voltage peak is less than a slope threshold, the computer is operable to store a corresponding error code in memory. The computer is also operable to process the ion voltage signal to determine a combustion quality value and a roughness value therefrom. If the combustion quality factor is outside a predefined range or if the roughness value exceeds a roughness threshold, the computer is operable to adjust engine fueling, spark timing and/or spark energy.

20 Claims, 11 Drawing Sheets

APPARATUS AND METHOD FOR DIAGNOSING AND CONTROLLING AN IGNITION SYSTEM OF AN INTERNAL COMBUSTION ENGINE

CROSS REFERENCE TO RELATED U.S. APPLICATION

This application is a divisional of U.S. application, Ser. No. 08/988,787 filed Dec. 11, 1997 now U.S. Pat. No. 6,006,156 issued Dec. 21, 1999.

FIELD OF THE INVENTION

The present invention relates to systems for diagnosing and controlling an ignition system of an internal combustion engine, and more specifically to such systems for detecting and logging predetermined ignition system failure modes as they occur and for controlling the ignition system in accordance with ignition system abnormalities.

BACKGROUND OF THE INVENTION

In electronic controls for internal combustion engines, it is known to electronically determine and control timing events associated with the engine ignition system in order to properly ignite air-fuel mixtures supplied to the engine. Typically, an engine control computer is responsive to crankshaft angle, engine coolant temperature, commanded engine fueling, intake air temperature and other engine operating conditions to produce appropriate firing command signals for generating high voltage sparks at a number of spark plugs, thereby resulting in combustion of the air-fuel mixture.

In the operation of a typical internal combustion engine ignition system, the engine control computer determines in a conventional manner an appropriate time to energize the primary side of an ignition coil associated with the engine (hereinafter referred to as a "firing command"). At that time, current begins to flow from a voltage source, such as a vehicle battery through the coil primary, thereby storing energy therein as is known in the art. Eventually, the current flowing through the coil primary reaches a peak level, and the engine control computer is thereafter operable to limit current flow therethrough to some desired level. After some period of current limiting, often referred to as a dwell time, the engine control computer deactivates the firing command, thereby open circuiting the coil primary.

The coil primary is typically magnetically coupled to a coil secondary, and when the primary is open circuited, a rapidly increasing voltage is induced in the coil secondary. The coil secondary is electrically connected to one or more spark plugs, and the rapidly increasing voltage induced therein is used to generate the required spark ignition voltage thereat.

Ignition systems of the type just described are typically constructed as an amalgamation of electrical and mechanical components, some of which are inherently subject to failure. Any of a number of ignition system failure modes are possible, most of which result in a degradation in combustion quality and/or misfiring of the engine. Heretofore, systems have been developed which are operable to distinguish between normal ignition system operation and misfire conditions so that appropriate adjustments can be made in the ignition strategy to thereby minimize subsequent misfire occurrences. One example of such a system is described in U.S. Pat. No. 5,606,118 to Muth et al.

Muth et al. disclose a misfire detection system wherein the primary coil voltage is monitored and compared with predefined threshold values. After a spark igniting voltage peak has occurred, the primary coil voltage waveform is repeatedly sampled. An average voltage as well as a peak voltage are calculated from the samples and a misfire indicating factor is calculated as a ratio thereof. If this ratio exceeds a predefined ratio threshold, then a misfire is indicated.

While the Muth et al. system is operable to distinguish between a normally operating ignition system and a misfire condition, it has several drawbacks associated therewith. For example, while it may effectively detect one or more misfire conditions, the Muth et al. system does not distinguish between any of the various possible ignition system failures. Thus, the Muth et al. system is incapable of providing any information relating to a particular cause of the misfire condition. Moreover, since the Muth et al. system is not operable to determine the cause of the misfire condition, it cannot properly use the misfire information to alter ignition and/or fuel strategies in real time to thereby minimize the effect of a particular cause of the misfire condition.

What is therefore needed is a system for diagnosing and controlling an ignition system of an internal combustion engine, wherein such a system is operable to detect, and distinguish between, a number of possible ignition system failure modes. Such a system should include at least the capability to store information relating to the types and number of occurrences of all ignition system failure modes which have occurred for later analysis, and should ideally be further capable of utilizing the information relating to any presently occurring ignition system failure mode to alter engine fueling, spark timing and/or spark energy during a subsequent firing command to thereby at least minimize the effect of the failure condition on proper engine operation.

SUMMARY OF THE INVENTION

The foregoing shortcomings of the prior art are addressed by the present invention. In accordance with one aspect of the present invention, a system for detecting ignition system failures comprises an ignition coil having a primary coil coupled to a secondary coil, means for energizing the primary coil to thereby induce a spark voltage in a high tension side of the secondary coil, a voltage sensor associated with the high tension side of the secondary coil, the voltage sensor sensing the spark voltage and producing a spark voltage signal corresponding thereto, and a computer having an input receiving the spark voltage signal. The computer analyzes the spark voltage signal and determines therefrom whether the spark voltage signal corresponds to an ignition system failure.

In accordance with another aspect of the present invention, a system for detecting ignition system failures, comprises an ignition coil having a primary coil coupled to a secondary coil, means for energizing the primary coil to thereby induce a spark voltage in a high tension side and an ion voltage in a low tension side of the secondary coil, an ion sensor associated with the low tension side of the secondary coil, the ion sensor sensing the ion voltage and producing an ion voltage signal corresponding thereto, and a computer having an input receiving the ion voltage signal. The computer analyzes the ion voltage signal and determines therefrom a combustion quality value associated with the spark voltage.

In accordance with a further aspect of the present invention, an apparatus for diagnosing ignition system failures comprises an ignition coil having a primary coil coupled to a secondary coil, means for energizing the primary coil to thereby induce a spark voltage signal in the secondary coil, and a first computer having an input coupled to the secondary coil for receiving the spark voltage signal. The computer includes a first memory having at least one spark voltage waveform stored therein corresponding to a spark voltage signal of a predefined ignition system failure mode, and the computer compares the spark voltage signal with the at least one spark voltage waveform and produces a diagnostic signal corresponding to a predefined ignition system failure mode if the spark voltage signal matches the at least one spark voltage waveform.

In accordance with yet another aspect of the present invention, an apparatus for predicting ignition system failures, comprises an ignition coil having a primary coil coupled to a secondary coil, a spark plug connected to a high tension side and to a low tension side of the secondary coil and defining a spark gap therebetween, an ignition control circuit connected to the primary coil and having an input responsive to a firing command to energize the primary coil to thereby induce a spark voltage in the high tension side of the secondary coil and a corresponding spark in the spark gap, the spark voltage exhibiting a voltage peak having a peak value corresponding to a breakdown voltage of the spark gap, and a first computer having an input coupled to the high tension side of the secondary coil for receiving the spark voltage. The first computer compares the peak value of the voltage peak with a threshold value and produces a prognostic signal corresponding to a predefined ignition system failure mode if the peak value is greater than the threshold value.

In accordance with still another aspect of the present invention, an apparatus for predicting ignition system failures, comprises an ignition coil having a primary coil coupled to a secondary coil, a spark plug connected to a high tension side and to a low tension side of the secondary coil and defining a spark gap therebetween, an ignition control circuit connected to the primary coil and having an input responsive to a firing command to energize the primary coil to thereby induce a spark voltage in the high tension side of the secondary coil and a corresponding spark in the spark gap, the spark voltage exhibiting a voltage peak having a peak value corresponding to a breakdown voltage of the spark gap, and a first computer having an input coupled to the high tension side of the secondary coil for receiving the spark voltage. The first computer compares a slope of the voltage peak about the peak value with a predefined slope value and produces a prognostic signal corresponding to a predefined ignition system failure mode if the slope of the peak value is less than the predefined slope value.

In accordance with yet a further aspect of the present invention, an apparatus for diagnosing ignition system failures comprises an ignition coil having a primary coil coupled to a secondary coil, a spark plug connected to a high tension side and to a low tension side of the secondary coil and defining a spark gap therebetween, an ignition control circuit connected to the primary coil having an input responsive to a firing command to energize the primary coil to thereby induce a spark voltage in the high tension side of the secondary coil and a corresponding spark in the spark gap, the spark voltage exhibiting a voltage peak having a peak value corresponding to a breakdown voltage of the spark gap, and a first computer having an input coupled to the high tension side of the secondary coil for receiving the spark voltage. The first computer determines a spark energy of the spark as a function of the peak value of the voltage peak and provides a spark energy correction signal as a function of the spark energy. The ignition control circuit is responsive to the spark energy correction signal to alter a spark energy of the spark induced in the spark gap.

In accordance with still a further aspect of the present invention, an apparatus for diagnosing ignition system failures comprises an ignition coil having a primary coil coupled to a secondary coil, means for energizing the primary coil to thereby induce a spark voltage in a high tension side of the secondary coil and an ion voltage in a low tension side of the secondary coil, a fueling system responsive to a fueling command signal to fuel an internal combustion engine, a first computer providing the fueling command signal to the fueling system, and a second computer having an input coupled to the low tension side of the secondary coil for receiving the ion voltage and a first output connected to the first computer. The second computer processes the ion voltage and determines a combustion quality value therefrom, and compares the combustion quality value with a first threshold value and provides a first fueling command correction signal at the first output if the combustion quality value exceeds the first threshold value. The first computer is responsive to the first fueling command correction signal to alter the fueling command signal to thereby decrease fuel supplied to the engine.

In accordance with yet a further aspect of the present invention, an apparatus for diagnosing ignition system failures comprises an ignition coil having a primary coil coupled to a secondary coil, means for energizing the primary coil to thereby induce a spark voltage in a high tension side of the secondary coil and an ion voltage in a low tension side of the secondary coil, a fueling system responsive to a fueling command signal to fuel an internal combustion engine, a first computer providing the fueling command signal to the fueling system, and a second computer having an input coupled to the low tension side of the secondary coil for receiving the ion voltage and a first output connected to the first computer. The second computer processes the ion voltage and determines a roughness value therefrom, compares the roughness value with a roughness threshold and provides a fueling command correction signal at the first output if the roughness value exceeds the roughness threshold. The first computer is responsive to the fueling command correction signal to alter the fueling command signal to thereby decrease fuel supplied to the engine.

One object of the present invention is to provide an ignition system for an internal combustion engine wherein the high tension side of the secondary winding of the ignition coil includes a spark voltage sensor.

Another object of the present invention is to provide an ignition system for an internal combustion engine wherein the low tension side of the secondary winding of the ignition coil includes an ion voltage sensor.

Yet another object of the present invention is to provide a diagnostic apparatus for an ignition system operable to sense spark voltage in the high tension side of the secondary winding of the ignition coil and compare the sensed spark voltage with a number of predefined spark voltage waveforms stored in memory to thereby determine whether the sensed spark voltage is exhibiting any of a number of predefined ignition system failure modes.

Still another object of the present invention is to provide a diagnostic apparatus for an ignition system operable to sense a voltage peak of the spark voltage in the high tension side of the secondary winding, wherein the voltage peak corresponds to the breakdown voltage of the spark gap of the spark plug, compare the voltage peak with a threshold peak, and store a corresponding prognostic failure code within memory whenever the peak voltage exceeds the threshold peak.

A further object of the present invention is to provide such a system operable to determine a slope of the spark voltage about the voltage peak and store a corresponding prognostic failure code within memory whenever the slope of the voltage peak is less than a predefined slope.

Still a further object of the present invention is to provide such a system operable to determine a spark energy as a function of the value of the voltage peak and alter the firing command timing (spark timing) to thereby induce a minimum spark energy in the spark gap, wherein the minimum spark energy corresponds to that required to establish breakdown in the gap and reliable ignition of the air/fuel mixture.

Yet a further object of the present invention is to provide a diagnostic apparatus for an ignition system operable to sense an ion voltage in the low tension side of the secondary winding of the ignition coil, process the ion voltage to determine a combustion quality value therefrom and alter an engine fueling command, firing timing command (spark timing) and/or spark energy if the combustion quality value is outside a predefined range of acceptable combustion quality values, and log a misfire error code in memory if the combustion quality value is below a misfire threshold value.

Still a further object of the present invention is to provide a diagnostic apparatus for an ignition system operable to sense an ion voltage signal in the low tension side of the secondary winding of the ignition coil, process the ion voltage signal to determine a roughness value thereof during a predefined time duration after an occurrence of peak cylinder pressure and alter an engine fueling command, firing command timing (spark timing) and/or spark energy if the roughness value exceeds a predefined roughness threshold value.

These and other objects of the present invention will become more apparent from the following description of the preferred embodiments.

DESCRIPTION OF THE PREFERRED EMBODIMENT

Figure 1:
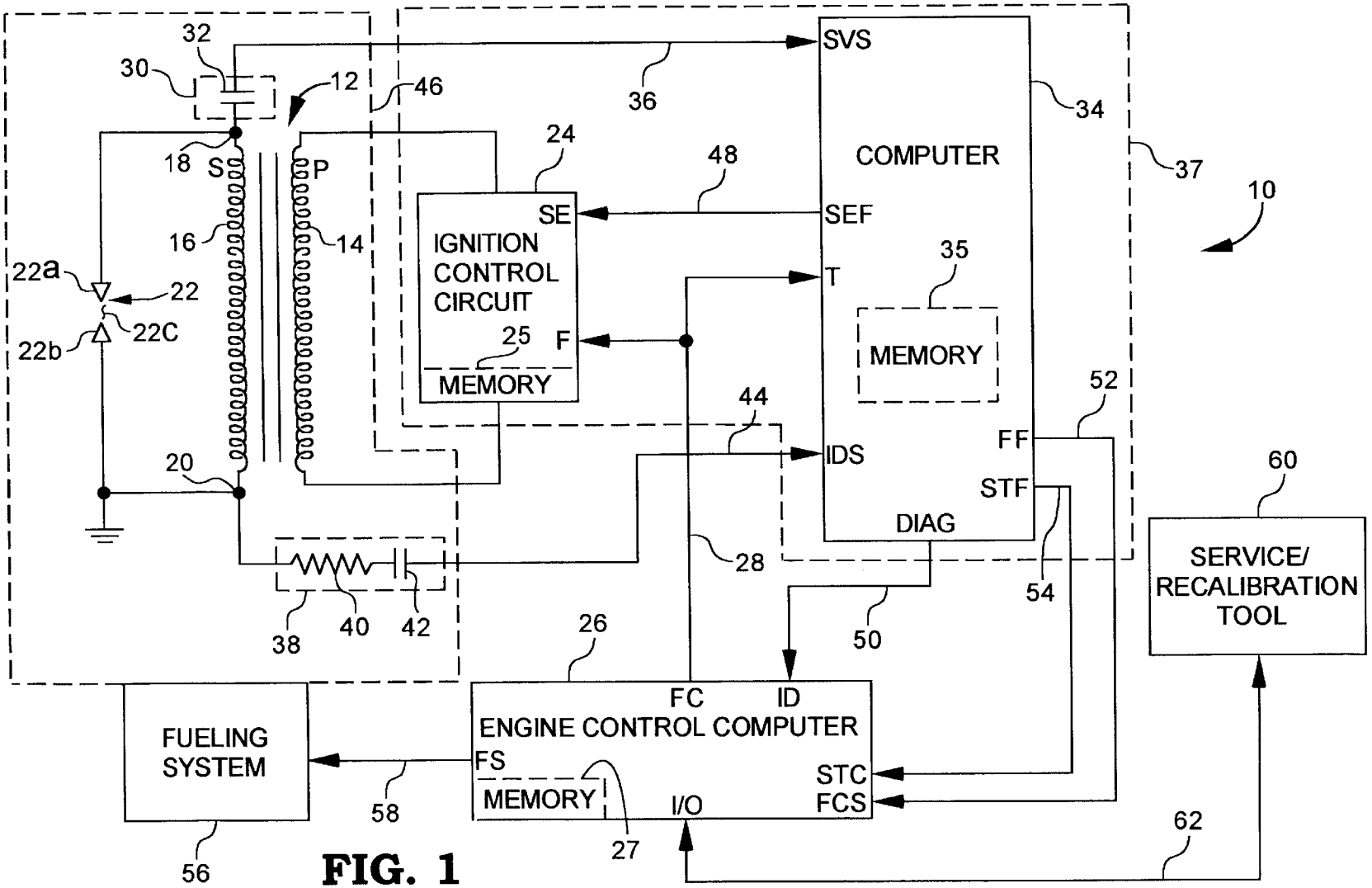
FIG. 1 is a diagrammatic illustration of an apparatus for diagnosing and controlling an ignition system of an internal combustion engine, in accordance with one aspect of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an apparatus 10 for diagnosing and controlling an ignition system of an internal combustion engine is shown, in accordance with the present invention. The ignition system includes an ignition coil 12 including a primary coil 14 magnetically coupled to a secondary coil 16 as is known in the art. The secondary coil defines a high voltage side (a.k.a. high tension side) having an output terminal 18 and a low voltage side (a.k.a. low tension side) having an output terminal 20. High and low tension outputs 18 and 20 are connected to a spark plug 22 in a conventional manner wherein the high tension output terminal 18 is connected to a first electrode 22*a* and the low tension terminal 20 is connected to a second electrode 22*b*, wherein the electrodes 22*a* and 22*b* define a spark gap 22*c* therebetween, and wherein the low tension output terminal 20 is typically electrically connected to ground potential via the engine block.

A known ignition control circuit 24 has a "fire" input F connected to a second computer, preferably a known engine control computer 26, via signal path 28, wherein the engine control computer 26 includes a memory section 27 and is responsive to a number of engine operating parameters (not shown, but discussed generally in the BACKGROUND SECTION) to produce a firing command signal on signal path 28 via a firing command output FC thereof. In a so-called single firing system, the firing command signal comprises a single control signal having both a time of occurrence and signal duration that are determined by the engine control computer 26 as is known in the art. In a so-called multiple firing system, on the other hand, the firing command signal comprises a sequence of control signals each having both a time of occurrence and signal duration that are determined by the engine control computer 26 as is known in the art. In either case, the ignition control circuit 24 is connected to the primary coil 14 and is responsive to the firing command signal to energize the primary coil 14 from a voltage source, such as a vehicle battery, as discussed in the BACKGROUND SECTION. Also as discussed in the BACKGROUND SECTION, the ignition control circuit 24 is responsive to deactivation of the firing command signal to open circuit the primary coil 12 which induces a spark voltage in the secondary coil 16 for generating a spark in the gap 22*c* between electrodes 22*a* and 22*b* of the spark plug 22.

In accordance with the present invention, a voltage sensor 30 is attached to the high tension side of the secondary coil 16 for sensing the spark voltage therein and providing a spark voltage signal corresponding thereto.

Although voltage sensor 30 may be electrically connected to the high tension output terminal 18 in accordance with any known technique as shown schematically in FIG. 1, it is preferably formed integral with the windings of the high tension side of the secondary coil 16. In one embodiment, voltage sensor 30 comprises a capacitor 32 having one end electrically connected to the high tension windings of the secondary coil 16 and an opposite end providing the spark voltage signal, although the present invention contemplates providing voltage sensor 30 as any known combination of ac voltage sensing components, including known filtering components, for example. The value of the capacitor 32 depends upon the particular ignition system and spark voltage characteristics, and should generally be chosen to provide a spark voltage signal that closely resembles the actual spark voltage provided to spark plug 22.

The spark voltage signal sensed by voltage sensor 30 is supplied to a spark voltage signal input (SVS) of a computer 34 via signal path 36. As the spark voltage signal will generally be an analog signal, the SVS input is preferably includes an analog-to-digital (A/D) converter operable to digitize the spark voltage signal at a suitable sampling rate (typically 1.0–1.4 $\mu$s) to thereby provide a digital representation of the spark voltage signal for subsequent processing by computer 34. Preferably, computer 34 is microprocessor-based and includes digital signal processing capabilities as well as a memory section 35. Alternatively, memory section 35 may be provided remote from computer 34, and additional remote memory may be used to supplement memory 35. In one embodiment, computer 34 is a Motorola 68332 processor, although the present invention contemplates utilizing any known computer, microprocessor and/or signal processor operable as described herein. One example of such an alternate computer is a microprocessor-based controller typically associated with a transmission extending from the internal combustion engine and typically coupled to engine control computer 26 via a communications bus such as an SAE J1939 data bus. All processing described herein by computer 34 may thus be alternatively be carried out by a transmission controller, wherein data is exchanged with the engine control computer 26 via the J1939 data bus. In another contemplated embodiment, ignition control circuit 24 and computer 34 may be combined into a single control circuit, which is illustrated by dashed box 37 in FIG. 1.

In accordance with another aspect of the present invention, a second voltage sensor 38 is attached to the low tension side of secondary coil 16. When the primary coil 14 induces a spark voltage in the secondary coil 16, which is provided to spark plug 22 at high tension output 18 thereof, a high impedance ion voltage is likewise induced in the secondary coil 16, which is provided to spark plug 22 at the low tension output 20 thereof. Although voltage sensor 38 may be electrically connected to the low tension output terminal 20 in accordance with any known technique as shown schematically in FIG. 1, it is preferably formed integral with the windings of the low tension side of the secondary coil 16. In one embodiment, voltage sensor 38 comprises a resistor 40 having one end electrically connected to the low tension windings of the secondary coil 16 and an opposite end connected to one end of a capacitor 42 with the opposite end of the capacitor 42 providing the ion voltage signal, although the present invention contemplates providing voltage sensor 38 as any known combination of high ac voltage sensing components operable to sense the high impedance ion voltage signal and provide an ion voltage signal corresponding thereto. The values of the resistor 40 and capacitor 38 depend upon the particular ignition system and ion voltage characteristics, and should generally be chosen to provide an ion voltage signal that closely resembles the actual ion voltage provided to spark plug 22.

The ion voltage signal sensed by voltage sensor 38 is supplied to an ion voltage signal input (IDS) of a computer 34 via signal path 44. As the ion voltage signal will generally be an analog signal, the IDS input is preferably includes an analog-to-digital (A/D) converter operable to digitize the ion voltage signal at a suitable sampling rate to thereby provide a digital representation of the ion voltage signal for subsequent processing by computer 34.

The ignition system components described thus far are shown in FIG. 1 as encompassed by a dashed polygon which is intended to represent an internal combustion engine 46. Some or all of such components may be attached to the engine 46 as is known in the art. Also attached to engine 46 is a known fueling system 56 having an input connected to a fuel signal output FS of computer 26 via signal path 58. As is known in the art, computer 26, which is preferably a known engine control computer, is operable to provide fueling command signals to fueling system 56 via signal path 58, to which fueling system 56 is responsive to provide fuel to engine 46. More specifically, fueling system 56 is responsive to the fueling command signals on signal path 58 to provide appropriate amounts of fuel to engine 46 to thereby provide each of the cylinders (not shown) of engine 46 with appropriate air-fuel ratios. Computer 26 also includes an input/output port I/O connectable to a known service/recalibration tool 60 via signal path 62, wherein tool 60 is preferably a computer-controlled device operable to transfer information, such as engine recalibration software, etc., to computer 26, and to extract information, such as engine/vehicle operating or diagnostics information, from computer 26 as is known in the art. Signal path 62 is preferably a known serial data communications bus, and in one embodiment is an SAE (Society of Automotive Engineers) J1587/J1708/J1939 data bus which operates in accordance with the technical specifications set forth in the SAE J1587/J1708/J1939 standard. According to the SAE J1587/J1708/J1939 industry bus standard, computer 26 and computer 34 are operable to both send and receive data relating to the operational parameters of the vehicle and/or engine 46.

Computer 34 further includes a trigger input T connected to signal path 28. Computer 34 is responsive to the firing command signal provided by computer 26 to trigger subsequent processing of the spark voltage signal provided by sensor 30 and/or the ion voltage signal provided by the sensor 38, which processing will be discussed in greater detail hereinafter.

Computer 34 further includes an ignition diagnostics output (DIAG) connected to an ignition diagnostics input (ID) of computer 26 via signal path 50. According to one aspect of the operation of system 10, the details of which will be described more fully hereinafter, computer 34 is operable to compare the spark voltage signal provided by sensor 30 with a number of spark voltage waveforms stored in memory 35 and generate an appropriate diagnostic signal depending upon which of the number of spark voltage waveforms matches the spark voltage signal provided by sensor 30. The number of spark voltage waveforms stored in memory 35 may include, for example, spark voltage waveforms of any of a number of known ignition system failure modes as well as a spark voltage waveform indicative of normal ignition system operation. In one embodiment, computer 34 is responsive to the diagnostic signal to store in memory 35 an appropriate flag or code corresponding to which of the number of spark voltage waveforms matches the spark voltage signal. For example, if the spark voltage signal matches the spark voltage waveform indicative of normal system operation, computer 34 stores a "normal" flag or code in memory 35. Conversely, if the spark voltage signal matches one of the spark voltage waveforms corresponding to a known ignition system failure mode, computer 34 stores a corresponding "error" flag or code in memory 35. In this embodiment, service/recalibration tool 60 may extract the flags or codes stored in memory 35 by interrogating computer 26 for such information, wherein computer 26 is responsive to such interrogation to extract the flags or codes from memory 35 via signal path 50, which may be a serial data link such as the SAE J1587/J1708/J1939 bus, and provide such information to tool 60 over serial data link 62. In an alternate embodiment, computer 34 provides the diagnostic signal to computer 26 via signal path 50, and computer 26 is operable to store an appropriate flag or code (such as a "normal" flag or code, or "error" flag or code) within memory 27 thereof. In this alternate embodiment, service/recalibration tool 60 may extract the flags or codes stored in memory 27 by interrogating computer 26 for such information, wherein computer 26 is responsive to such interrogation to extract the flags or codes from memory 27 and provide such information to tool 60 over serial data link 62.

Computer 34 further includes a spark energy feedback output SEF connected to a spark energy input SE of ignition control circuit 24 via signal path 46. According to one aspect of the operation of system 10, the details of which will be described more fully hereinafter, computer 34 is operable to determine from the spark voltage signal provided by sensor 30 and/or the ion voltage signal provided by sensor 38 a spark energy correction signal which is provided by computer 34 on signal path 48. The ignition control circuit 24 is responsive to the spark energy correction signal provided to input SE thereof by computer 34 to adjust the energy of the spark induced in the spark gap 22*c*. Ignition control circuit 24 is preferably operable to adjust the spark energy by either altering the duration of the firing command signal of a single firing system or by altering the number of firing commands and/or durations of the firing command signals of a multiple firing system. Those skilled in the art will, however, recognize that computer 34 may alternatively provide the spark energy correction signal to computer 26 which may be operable to process this signal and alter the firing command signal provided at output FC thereof accordingly. In this alternate embodiment, computer 26 is thus operable to adjust the spark energy and provide an "adjusted" firing command signal to the ignition control circuit 24 to implement the adjustment in spark energy. The phrase "ignition control circuit responsive to a spark energy correction signal to alter (increase or reduce) the firing command to thereby alter the spark energy of the spark induced in the spark gap" or equivalent phrase, as used hereinafter, should accordingly be understood to mean that the ignition control circuit 24 is responsive to either the spark energy feedback signal provided on signal path 48 by computer 34 or a spark energy adjusted firing command signal provided on signal path 28 by computer 26, to implement a corresponding adjustment in the spark energy of the spark induced in the spark gap 22*c* of spark plug 22.

Computer 34 further includes a spark timing feedback output STF connected to a spark timing correction input STC of computer 26 via signal path 54. According to one aspect of the operation of system 10, the details of which will be described more fully hereinafter, computer 34 is operable to determine from the ion voltage signal provided by sensor 38 a spark timing correction signal which is provided by computer 34 on signal path 54. The computer 26 is responsive to the spark timing correction signal provided to input STC thereof by computer 34 to alter the timing of the firing command signal provided at output FC thereof. More specifically, computer 26 is responsive to the spark timing correction signal provided on signal path 54 to either advance or retard the firing command timing to thereby correspondingly advance or retard the time at which the ignition control circuit 25 energizes the primary coil 14 of ignition coil 12. Those skilled in the art will, however, recognize that computer 34 may alternatively provide the spark timing correction signal to the ignition control circuit 24 which may be operable to process this signal and alter the timing of the firing command signal provided to input F thereof, it being understood however, that such an arrangement may only be used to advance the timing of the firing command signal and not to retard it. In this alternate embodiment, the ignition control circuit 24 is thus operable to advance the spark timing by adjusting its time of response to the firing command signal provided to input F thereof.

Computer 34 further includes a fueling feedback output FF connected to a fuel correction signal input FCS of computer 26 via signal path 52. According to one aspect of the operation of system 10, the details of which will be described more fully hereinafter, computer 34 is operable to determine from the ion voltage signal provided by sensor 38 a fueling command correction signal which is provided by computer 34 on signal path 52. The computer 26, preferably an engine control computer, is responsive to the fueling command correction signal provided to input FCS thereof by computer 34 to alter the fueling command signal provided to fueling system 56 via signal path 56 to thereby correspondingly alter (increase or decrease) the fuel supplied by fueling system 56 to engine 46 (and consequently the air-fuel ratios provided to the engine cylinders).

Referring now to FIGS. 2A–2G, a number of spark voltage signal waveforms are shown, which waveforms are preferably stored in memory 35 of computer 34 as described hereinabove. In accordance with one aspect of the present invention, computer 34 is responsive to the firing command signal received at the trigger input T thereof to sample the spark voltage signal provided by sensor 30, at an appropriate sampling rate, and compare the sampled spark voltage signal with the number of spark voltage waveforms stored in memory 35, and store an appropriate flag or code in either memory 35 or memory 27 in response thereto, as described hereinabove. Preferably, comparisons of the sampled spark voltage waveform with the number of spark voltage waveforms stored in memory 35 are performed in accordance with a known signature analysis technique wherein a number of points of the sampled spark voltage waveform over a predefined time span are compared with corresponding points of the spark voltage waveforms stored in memory 35. If the number of points of the sampled spark voltage waveform match any of the spark voltage waveforms stored in memory 35, within an allowable error band, computer 34 generates an appropriate diagnostic signal. Either computer 34 or computer 26 is responsive to the diagnostic signal to store a corresponding flag or code in memory 35 or memory 27, as described hereinabove. Those skilled in the art will, however, recognize that other known techniques may alternatively be employed by computer 34 in determining whether the sampled spark voltage signal matches any of the number of spark voltage waveforms stored in memory 35.

Figure 2A:
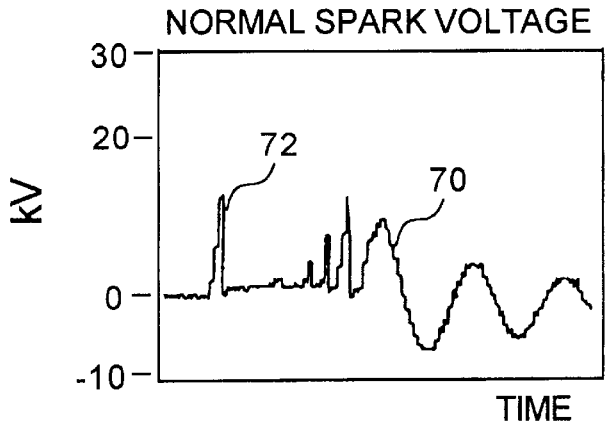
FIG. 2A is a plot of spark voltage vs time for a firing command associated with a single cylinder, illustrating a normal spark voltage signature.

Referring now to FIG. 2A, an example spark voltage waveform or signature 70 is illustrated, wherein waveform 70 corresponds to a normal spark voltage waveform or signature. As shown in FIG. 2A, the normal spark voltage waveform 70 exhibits a first voltage peak 72 which, in the example shown, is slightly less than 20 kv. The peak value of voltage peak 72 corresponds to the breakdown voltage of the spark gap 22*c* of spark plug 22, wherein such a breakdown event allows subsequent generation of an arc within gap 22*c* between electrodes 22*a* and 22*b* as is known in the art. Computer 34 is operable to compare the sampled spark voltage signal with the spark voltage waveform 70 of FIG. 2A, as described hereinabove, and produce a diagnostic signal from which a "normal" flag or code can be stored in an appropriate memory if a match therebetween is determined.

Figure 2B:
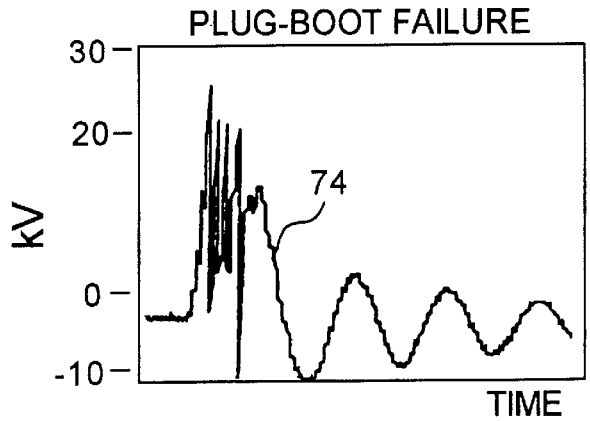
FIG. 2B is a plot of spark voltage vs time for a firing command associated with a single cylinder, illustrating a spark voltage signature corresponding to a plug-boot failure.

Referring now to FIG. 2B, an example spark voltage waveform or signature 74 of one known ignition system failure mode is illustrated. Specifically, spark voltage waveform 74 is characteristic of a plug-boot failure wherein an arc occurs between the top of electrode 22*a* (the portion of electrode 22*a* connected directly to the high tension side of the secondary coil 18) and electrode 22*b* (typically at a metal shell surrounding a lower portion of plug 22 and connected to electrode 22*b*), which failure mode is typically referred to as a "flashover" condition. Computer 34 is operable to compare the sampled spark voltage signal with the spark voltage waveform 74 of FIG. 2B, as described hereinabove, and produce a diagnostic signal from which a corresponding error flag or code can be stored in an appropriate memory if a match therebetween is determined.

Figure 2C:
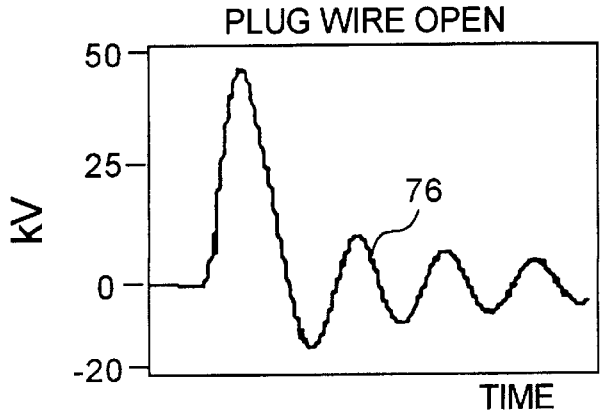
FIG. 2C is a plot of spark voltage vs time for a firing command associated with a single cylinder, illustrating a spark voltage signature corresponding to a plug wire open failure.

Referring now to FIG. 2C, an example spark voltage waveform or signature 76 of another known ignition system failure mode is illustrated. Specifically, spark voltage waveform 76 is characteristic of a plug wire open failure wherein the electrical conductor connecting electrode 22*a* to high tension output terminal 18 of secondary coil 16 is open circuited somewhere there along. Computer 34 is operable to compare the sampled spark voltage signal with the spark voltage waveform 76 of FIG. 2C, as described hereinabove, and produce a diagnostic signal from which a corresponding error flag or code can be stored in an appropriate memory if a match therebetween is determined.

Figure 2D:
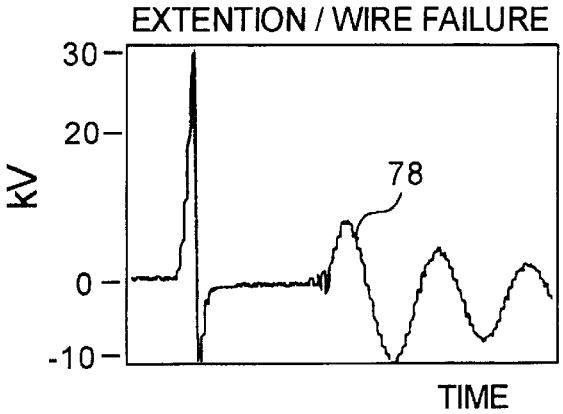
FIG. 2D is a plot of spark voltage vs time for a firing command associated with a single cylinder, illustrating a spark voltage signature corresponding to an extension/wire failure.

Referring now to FIG. 2D, an example spark voltage waveform or signature 78 of yet another known ignition system failure mode is illustrated. Specifically, spark voltage waveform 78 is characteristic of an extension/wire failure wherein an arc occurs between the electrode 22*a*, or the electrical conductor connecting electrode 22*a* to the high tension output terminal 18 of secondary coil 16, to ground potential (typically the engine block) via a path internal to the spark plug 22, which failure mode is typically referred to as a "punch-through" condition. Computer 34 is operable to compare the sampled spark voltage signal with the spark voltage waveform 78 of FIG. 2D, as described hereinabove, and produce a diagnostic signal from which a corresponding error flag or code can be stored in an appropriate memory if a match therebetween is determined.

Figure 2E:
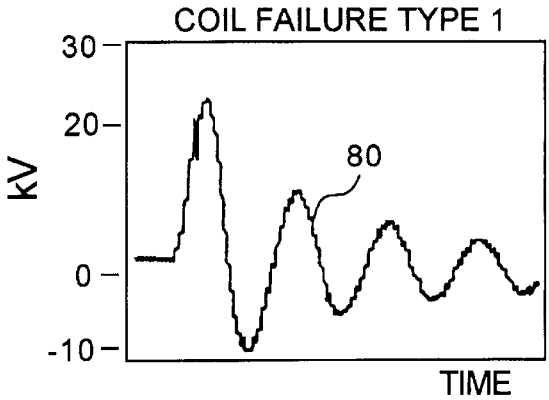
FIG. 2E is a plot of spark voltage vs time for a firing command associated with a single cylinder, illustrating a spark voltage signature corresponding to a type 1 coil failure.

Referring now to FIG. 2E, an example spark voltage waveform or signature 80 of still another known ignition system failure mode is illustrated. Specifically, spark voltage waveform 80 is characteristic of a first coil failure type wherein an arc occurs between the primary coil 14 and secondary coil 16 of ignition coil 12, typically internally to the ignition coil 12. Computer 34 is operable to compare the sampled spark voltage signal with the spark voltage waveform 80 of FIG. 2E, as described hereinabove, and produce a diagnostic signal from which a corresponding error flag or code can be stored in an appropriate memory if a match therebetween is determined.

Figure 2G:
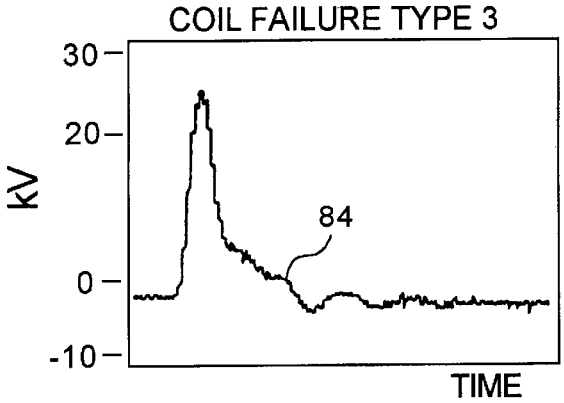
FIG. 2G is a plot of spark voltage vs time for a firing command associated with a single cylinder, illustrating a spark voltage signature corresponding to a type 3 coil failure.
Figure 2F:
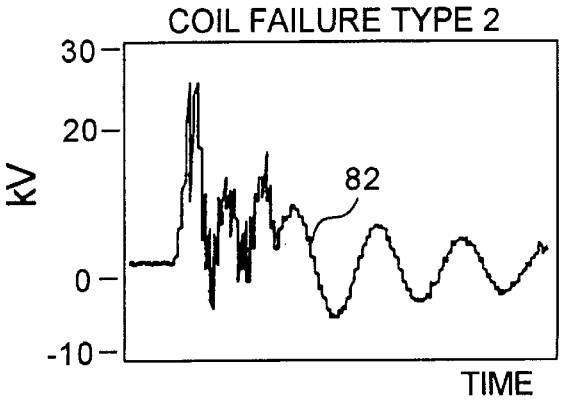
FIG. 2F is a plot of spark voltage vs time for a firing command associated with a single cylinder, illustrating a spark voltage signature corresponding to a type 2 coil failure.

Referring now to FIG. 2F, an example spark voltage waveform or signature 82 of a further known ignition system failure mode is illustrated. Specifically, spark voltage waveform 82 is characteristic of a second coil failure type wherein an arc occurs between any of the windings of the secondary coil 16 of ignition coil 12. Computer 34 is operable to compare the sampled spark voltage signal with the spark voltage waveform 82 of FIG. 2F, as described hereinabove, and produce a diagnostic signal from which a corresponding error flag or code can be stored in an appropriate memory if a match therebetween is determined.

Referring now to FIG. 2G, an example spark voltage waveform or signature 84 of yet a further known ignition system failure mode is illustrated. Specifically, spark voltage waveform 84 is characteristic of a third coil failure type wherein an electrical short occurs between a number of the windings of the secondary coil 16 of ignition coil 12. Computer 34 is operable to compare the sampled spark voltage signal with the spark voltage waveform 84 of FIG. 2G, as described hereinabove, and produce a diagnostic signal from which a corresponding error flag or code can be stored in an appropriate memory if a match therebetween is determined.

Figure 3A:
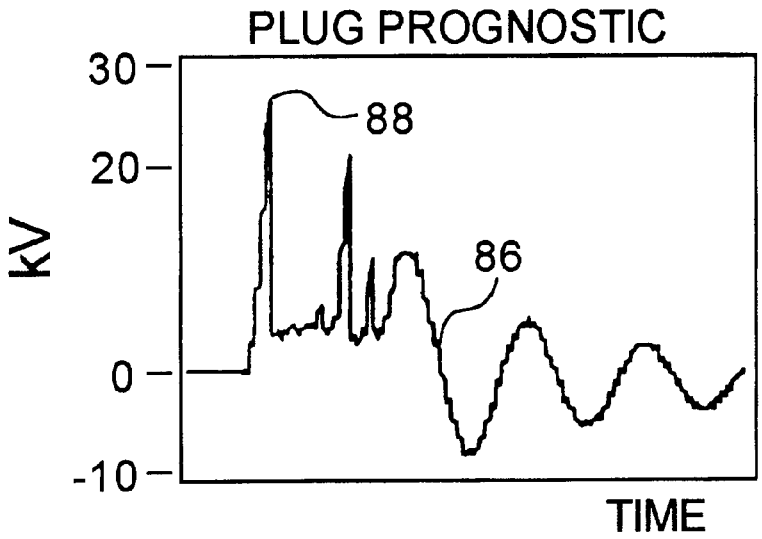
FIG. 3A is a plot of spark voltage vs time for a firing command associated with a single cylinder, illustrating a spark voltage signature corresponding to a plug prognostic failure.
Figure 3B:
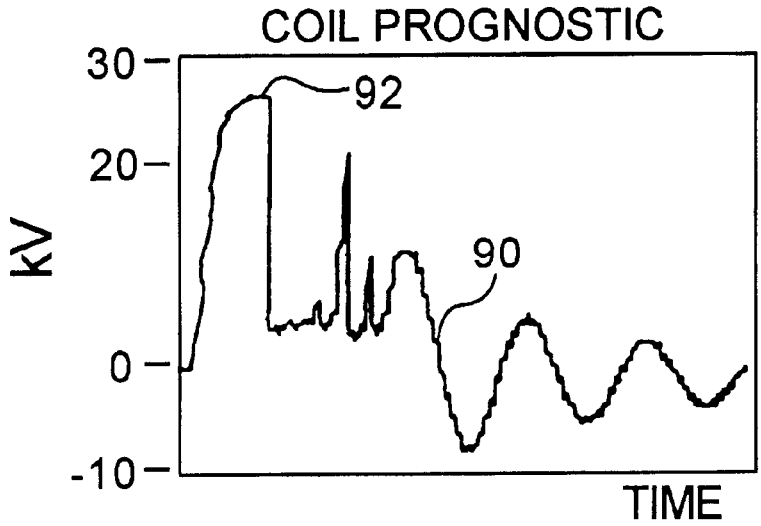
FIG. 3B is a plot of spark voltage vs time for a firing command associated with a single cylinder, illustrating a spark voltage signature corresponding to a coil prognostic failure.

Referring now to FIGS. 3A and 3B, a pair of sampled spark voltage signals are shown which correspond to two different spark voltage signal related failures which may occur in ignition system 10. In accordance with another aspect of the present invention, computer 34 is operable to process the sampled spark voltage signals in order to determine certain characteristics of the first voltage peak (e.g. voltage peak 72 of spark voltage waveform 70 of FIG. 2A), wherein this peak corresponds to the breakdown voltage of the spark gap 22*c*.

Referring now to FIG. 3A, a sampled spark voltage signal 86 is illustrated which corresponds to a plug prognostic failure wherein the peak value of the first voltage peak 88 (i.e. the breakdown voltage $V_{BD}$ of spark gap 22*c*) is excessively high. Peak 88, as illustrated in FIG. 3A, is slightly less than 30 kv as compared with the voltage peak 72 of FIG. 2A which is slightly less than 20 kv. In accordance with an important aspect of the present invention, as described hereinabove, computer 34 is operable to detect a peak value of the first voltage peak 88 and compare this with a peak threshold value. In one embodiment, the peak threshold value is set equal to the "normal" peak value of approximately 20 kv, although the present invention contemplates setting the peak threshold value at any voltage level for which the corresponding breakdown voltage $V_{BD}$ is considered to be excessively high. If computer 34 determines that the peak value of the first voltage peak 88 (i.e. spark gap breakdown voltage $V_{BD}$) exceeds the peak threshold value, computer 34 is preferably operable to produce a first prognostic signal. As described hereinabove with respect to FIGS. 2A–2G, computer 34 may, in one embodiment, be responsive to the first prognostic signal to store a corresponding first prognostic code in memory 35. Alternatively, computer 34 may provide the first prognostic signal to computer 26 via signal path 50, wherein computer 26 is operable to store the first prognostic code within memory 27. In either case, service/recalibration tool 60 may be connected to I/O of computer 26 to extract the first prognostic code from either of memory 35 or memory 27 as described hereinabove. As long as the voltage peak 88 is below the peak threshold value, the first prognostic code indicates normal operating conditions. However, when the voltage peak 88 exceeds the peak threshold value, the first prognostic code provides an indication that the corresponding spark plug is beginning to foul and should therefore be replaced. The present invention thus provides for a prognostic spark plug analysis system wherein pending failure of one or more of the spark plugs associated with the internal combustion engine 46 may be predicted. Such a system provides advance warning of pending failure conditions so that maintenance times may be scheduled and/or parts may be ordered in advance of actual failure conditions to thereby minimize down time and schedule conflicts.

Referring now to FIG. 3B, a sampled spark voltage signal 90 is illustrated which corresponds to a coil prognostic failure wherein the first voltage peak 92 (i.e. the breakdown voltage $V_{BD}$ of spark gap 22*c*) is rounded. In accordance with another important aspect of the present invention, as described hereinabove, computer 34 is operable to determine a slope of the first voltage peak 92, particularly about its peak value, and compare this computed slope with a predefined slope value. In one embodiment, computer 34 includes a differentiator operable to compute the slope of the first voltage peak 92, although the present invention contemplates that computer 34 may alternatively be equipped to compute the slope of the first voltage peak 92 in accordance with any known slope-determining technique. In any case, the slope of the first voltage peak 92 provides an indication of whether the peak value thereof is sharply defined (i.e. occurs instantaneously in time) or whether the peak value has broadened out over some time interval. In one embodiment, the predefined slope value is accordingly set equal to zero, although the present invention contemplates setting the predefined slope value to any value below which the peak value of the first voltage peak 92 is not sharply defined. If computer 34 determines that the slope of the first voltage peak 92 about the peak value (i.e. spark gap breakdown voltage $V_{BD}$) exceeds the predefined slope value, computer 34 is preferably operable to produce a second prognostic signal. As described hereinabove with respect to FIGS. 2A–2G, computer 34 may, in one embodiment, be responsive to the second prognostic signal to store a corresponding second prognostic code in memory 35. Alternatively, computer 34 may provide the second prognostic signal to computer 26 via signal path 50, wherein computer 26 is operable to store the second prognostic code within memory 27. In either case, service/recalibration tool 60 may be connected to I/O of computer 26 to extract the second prognostic code from either of memory 35 or memory 27 as described hereinabove. As long as the slope of the first voltage peak 92 is below the predefined slope value, the second prognostic code indicates normal operating conditions. However, when the slope of the first voltage peak 92 exceeds the predefined slope value, the second prognostic code provides an indication that the corresponding coil is beginning to fail and should therefore be replaced. The present invention thus provides for a prognostic coil analysis system wherein pending failure of one or more of the coils associated with the internal combustion engine 46 may be predicted. Such a system provides advance warning of pending failure conditions so that maintenance times may be scheduled and/or parts may be ordered in advance of actual failure conditions to thereby minimize down time and schedule conflicts.

In accordance with yet another aspect of the present invention, computer 34 is operable at all times (i.e. regardless of whether any of the ignition system failure modes illustrated in FIGS. 2A–3B are present) to monitor the sampled spark voltage signal and compute a spark energy value therefrom which corresponds to the energy of the spark induced in the spark gap 22*c* of spark plug 22. In particular, computer 34 is operable to determine the spark gap breakdown voltage $V_{BD}$ from the sampled spark voltage signal as described hereinabove and in accordance with known techniques. Preferably, information relating to the distance G between electrode 22*a* and electrode 22*b* (spark gap dimension) is stored in memory 35 of computer 34, so that an in-cylinder density δ can be computed in a known manner by computer 34 as a function of the breakdown voltage $V_{BD}$ and spark gap G (22*c*), or $$\delta=f(G,V_{BD}) \quad (1).$$

In accordance with another known equation, the minimum energy necessary to induce a spark in the spark gap is a function of the spark gap G, or $$E_{min}=f(G) \quad (2).$$

Finally, it is also known that a minimum spark gap $G_{min}$ is necessary to prevent quenching, wherein $G_{min}$ is a function of the air-fuel ratio λ of the cylinder being fueled, or $$G_{min}=f(\lambda)/\delta \quad (3).$$

Combining equations (1), (2) and (3), $$E_{min}=f(V_{BD},G,f(\lambda)) \quad (4).$$

From the foregoing equations (1)–(4), it can be seen that the minimum energy necessary to induce breakdown of the spark gap G can be computed by determining the breakdown voltage $V_{BD}$ (via a determination of the peak value of the corresponding voltage peak of the spark voltage waveform), determining values for G and f(λ), and computing $E_{min}$ therefrom. Preferably, G is a known value and stored within memory 35, and f(λ) is computed by computer 26 and supplied to computer 34 through suitable means such as by a data link established therebetween (not shown), although the present invention contemplates that both G and f(λ) may be values stored within memory 35 of computer 34. In any case, computer 34 is operable to compute a spark energy correction signal based on the computed value of $E_{min}$ and provide this signal at output SEF thereof. As described hereinabove, the ignition control circuit 24 is responsive (either directly or via computer 26) to the spark energy correction signal to correspondingly alter the firing command signal provided to input F thereof to thereby energize the primary coil 14 and induce a spark in spark gap 22*c* having a spark energy of $E_{min}$. Thus, an important feature of the present invention lies in its ability to constantly (i.e. once every firing cycle) adjust the firing command signal to thereby maintain the spark energy at a minimum energy required to achieve breakdown across the spark gap 22*c*. If the spark energy is maintained at this minimum value, erosion of electrodes 22*a* and 22*b* is thereby minimized.

Figure 4A:
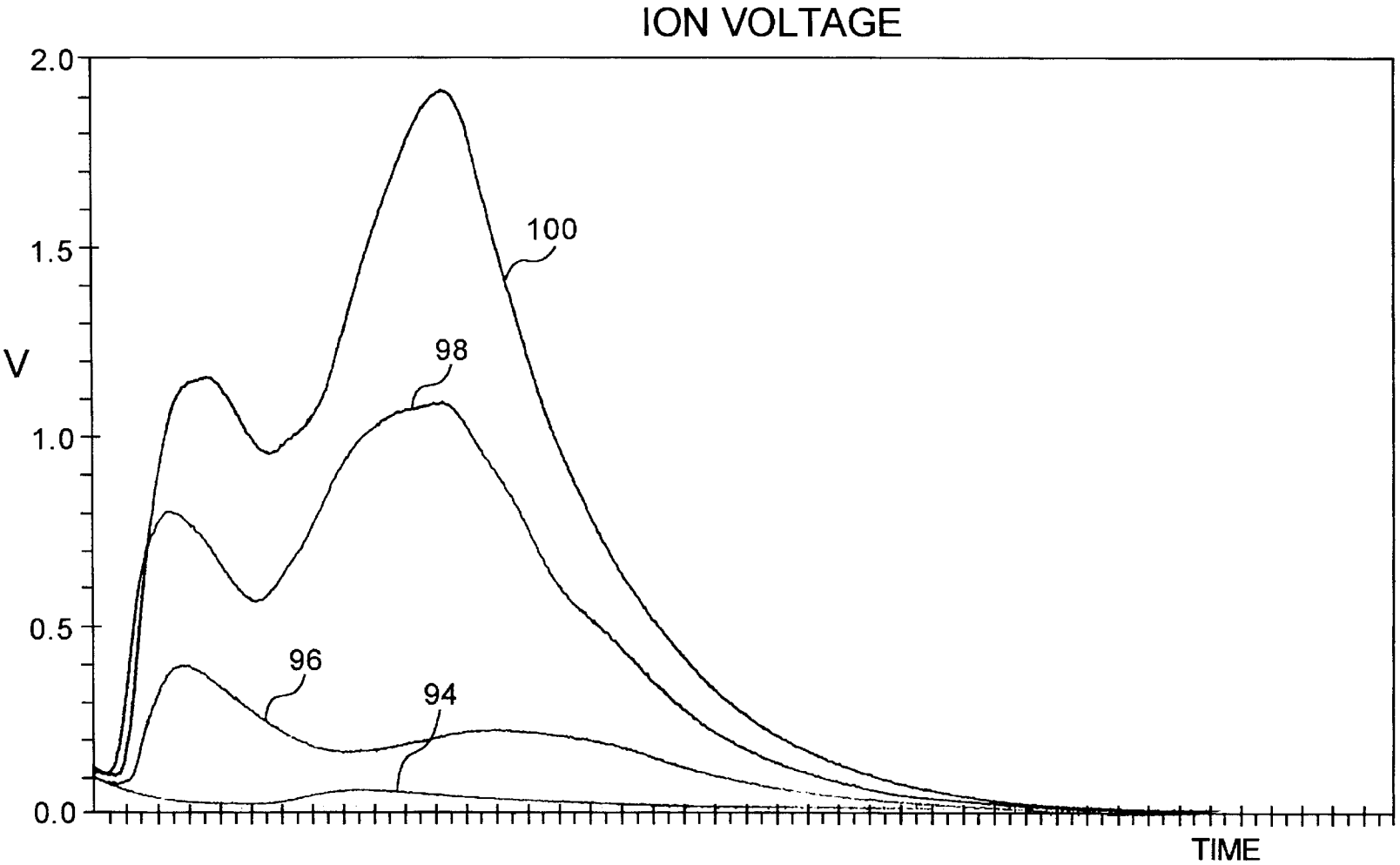
FIG. 4A is a plot of ion-gap voltage vs time for a firing command associated with a single cylinder, illustrating a preferred technique for diagnosing air/fuel combustion quality.
Figure 4B:
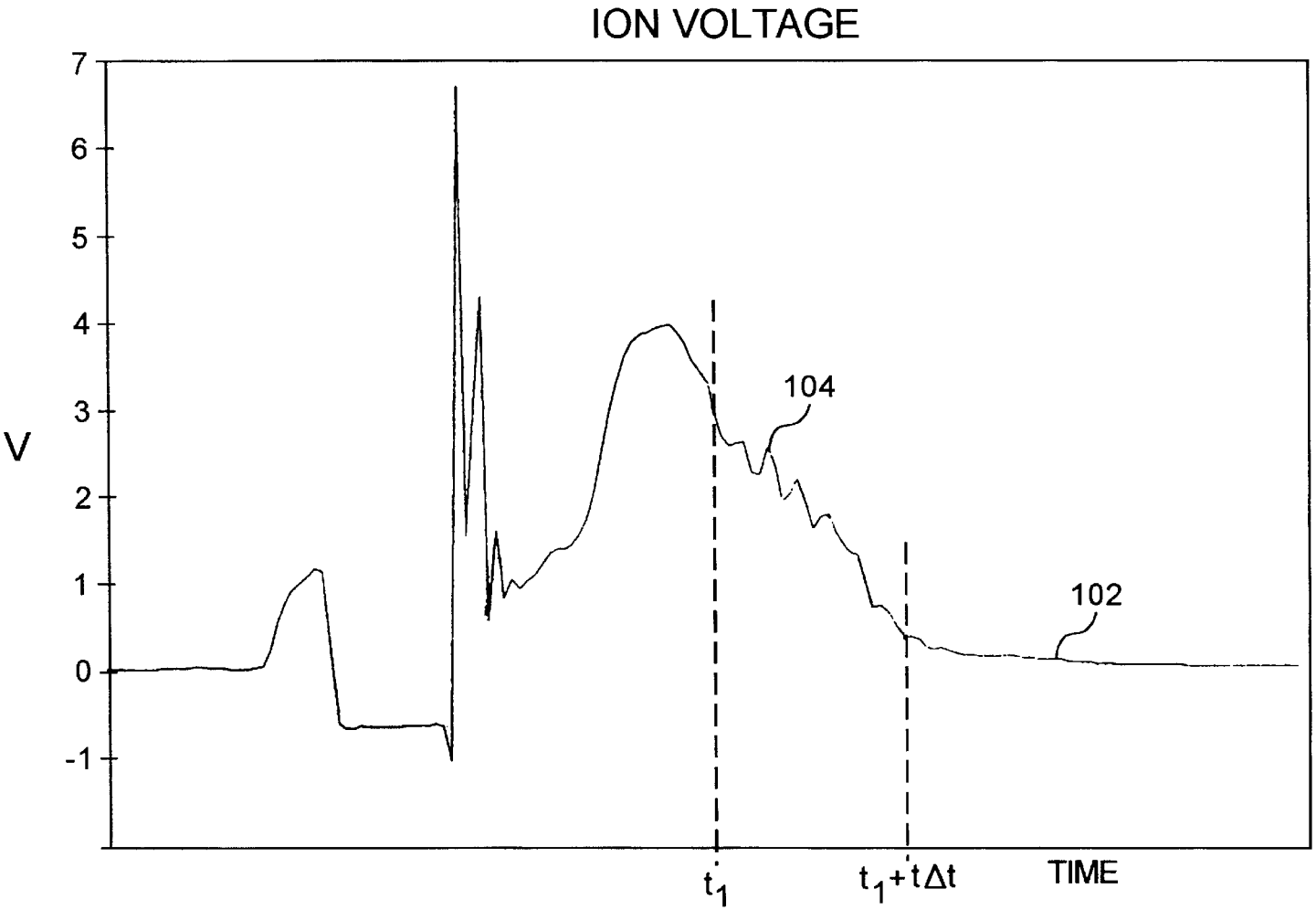
FIG. 4B is a plot of ion-gap voltage vs time for a firing command associated with a single cylinder, illustrating a preferred technique for diagnosing knock conditions.

Referring now to FIGS. 4A and 4B, computer 34 is operable to sample ion voltage signals provided by sensor 38, at a suitable sampling rate, process the ion voltage signals and adjust one or more of the operational parameters associated with the ignition system 10 to thereby optimize combustion quality. Referring specifically to FIG. 4A, a number of sampled ion voltage signals are illustrated as a function of time wherein each of the signals represent 20 cycle averages (ion voltage signals averaged over 20 firing cycles). The ion voltage signal 98 represents an ion voltage signal under normal engine operating conditions and under normal operation of ignition system 10.

In operation, computer 34 is operable to process the ion voltage signal and determine a combustion quality value therefrom. In one embodiment, computer 34 is operable to do so by computing the area under the ion voltage signal over a predefined time period (preferably between t=0 and a time t whereafter the ion voltage signal is equal, or sufficiently close, to 0), wherein the area under the ion voltage signal provides an indication of combustion quality. Within a predefined range of area values, combustion quality increases as the area value increases, and decreases as the area value decreases. An example range of such area values is illustrated graphically in FIG. 4A by a minimum acceptable ion voltage signal 96 and a maximum acceptable ion voltage signal 100. Below ion voltage signal 96, any such signals would have an area value corresponding to unacceptable combustion quality. Likewise, above ion voltage signal 100, any such signals would have an area value corresponding to unacceptable combustion quality. Computer 34 is thus operable to compare the sampled ion voltage signal with the range limits and determine whether the combustion quality exhibited by the sample ion voltage signal is acceptable or unacceptable. In one embodiment, computer 34 is operable to do so by computing the area under the sampled ion voltage signal and comparing this area value to an area value corresponding to an area value of an ion voltage signal occurring at the top of the range limit (hereinafter "upper area boundary") and also to an area value corresponding to an area value of an ion voltage signal occurring at the bottom of the range limit (hereinafter "lower area boundary"). If the area value of the sampled ion voltage signal is larger than the upper area threshold, then computer 34 determines that combustion quality is unacceptable and accordingly adjusts certain operating parameters of ignition system 10 and/or fueling system 56.

In one embodiment, computer 34 is responsive to the area under the sampled ion voltage signal exceeding the upper area boundary to provide a first fueling correction signal to computer 26 via signal path 52. Computer 26 is responsive to the first fueling command correction signal to alter the fueling command signal provided to fueling system 56 via signal path 58 to thereby decrease the amount of fuel supplied to the engine 14. Preferably, computer 34 keeps track of the number of firing cycles (number of firing command signals received at the trigger input T thereof), and provides the first fueling command correction signal during the first firing cycle that the unacceptable combustion condition is detected. During the following firing cycle (i.e. after the fueling command signal has been corrected as just described), computer 34 again makes a determination of whether the area under the sampled ion voltage signal exceeds the upper area boundary. If so, computer 34 is operable to provide a first ignition timing correction signal to computer 26 via signal path 54. Computer 26 is responsive to the first ignition timing correction signal to alter the firing command signal provided to the ignition control circuit 24 via signal path 28 to thereby retard the time at which ignition control circuit 24 energizes the primary coil 14 as described hereinabove. During the following firing cycle (i.e. after both the fueling command signal and the firing command signal have been corrected as just described), computer 34 again makes a determination of whether the area under the sampled ion voltage signal exceeds the upper area boundary. If so, computer 34 is operable to provide a first spark energy correction signal to ignition control circuit 24 via signal path 48. Ignition control circuit 24 is responsive to the first spark energy correction signal to reduce the spark energy, as described hereinabove, by suitably altering the duration and/or number of firing command signals provided by computer 26 on signal path 28.

Computer 34 is further preferably responsive to the area under the sampled ion voltage signal being less than the lower area boundary to provide a second fueling correction signal to computer 26 via signal path 52 during the first firing cycle. Computer 26 is responsive to the second fueling command correction signal to alter the fueling command signal provided to fueling system 56 via signal path 58 to thereby increase the amount of fuel supplied to the engine 14. During the following firing cycle (i.e. after the fueling command signal has been corrected as just described), computer 34 again makes a determination of whether the area under the sampled ion voltage signal is less than the lower area boundary. If so, computer 34 is operable to provide a second ignition timing correction signal to computer 26 via signal path 54. Computer 26 is responsive to the second ignition timing correction signal to alter the firing command signal provided to the ignition control circuit 24 via signal path 28 to thereby advance the time at which ignition control circuit 24 energizes the primary coil 14 as described hereinabove. During the following firing cycle (i.e. after both the fueling command signal and the firing command signal have been corrected as just described), computer 34 again makes a determination of whether the area under the sampled ion voltage signal is less than the lower area boundary. If so, computer 34 is operable to provide a second spark energy correction signal to ignition control circuit 24 via signal path 48. Ignition control circuit 24 is responsive to the second spark energy correction signal to increase the spark energy, as described hereinabove, by suitably altering the duration and/or number of firing command signals provided by computer 26 on signal path 28.

Ion voltage signal 94 shown in FIG. 4A represents a signal having an area value (hereinafter "misfire area boundary") below which any lesser ion voltage signal corresponds to an engine misfire. Computer 34 is thus operable to compare the area under the sampled ion voltage signal with the misfire area boundary and, if the area under the sampled ion voltage signal is larger than the misfire area boundary, and the combustion quality is otherwise acceptable, computer 34 preferably stores a flag or code within memory 35 indicative of normal (i.e. non-misfire) operation. If, on the other hand, computer 34 determines that the area under the sampled ion voltage signal is less than the misfire area boundary, computer 34 stores a corresponding misfire flag or code within memory 35. Alternatively, computer 34 may pass such information to computer 26 for storage within memory 27. In either case, service/recalibration tool 60 is operable, as described hereinabove, to extract the flag or code information from the appropriate memory device.

Computer 34 is alternatively operable to process the ion voltage signal and perform a combustion quality analysis by comparing the ion voltage signal (such as ion voltage signal 98) with a predefined ion voltage waveform stored in memory, in a similar manner to the techniques described with respect to FIGS. 2A–2G. In other words, computer 34 may alternatively be operable to perform a signature analysis technique with respect to the sensed ion voltage signal and determine therefrom a combustion quality value. For example, if computer 34 determines that the sensed ion voltage signal exceeds the predefined ion voltage signal waveform by a first threshold amount, then subroutine B of FIG. 6B may be performed. On the other hand, if computer 34 determines that the predefined ion voltage signal waveform exceeds the sensed ion voltage signal by a second threshold amount, then subroutine A of FIG. 6A may be performed. Finally, if computer 34 determines that the predefined ion voltage signal waveform exceeds the sensed ion voltage signal by a third threshold amount, then computer 34 may be operable to store a corresponding misfire code within memory as described hereinabove.

Referring now to FIG. 4B, a single ion voltage signal 102 is illustrated. In accordance with yet another aspect of the present invention, computer 34 is operable to process a portion of the sampled ion voltage signal and determine therefrom a roughness value corresponding to engine knock. In one embodiment, computer 34 is operable to determine a time t, at which to begin the roughness analysis of the sampled ion voltage signal. Thereafter, computer 34 performs the roughness analysis until a time $t_1+\Delta t$. Preferably, the time $t_1$ corresponds to a point in time of the firing cycle that corresponds to peak cylinder pressure, whereafter any engine knocking indication will be manifested in the sampled ion voltage signal. In one embodiment, computer 34 performs the roughness analysis of the sampled ion voltage signal between the times $t_1$ and $t_1+\Delta t$ by analyzing frequency components above some predefined frequency of the sampled ion voltage signal. If the sampled ion voltage signal exhibits a sufficient number of high frequency peaks 104 having peak values larger than some peak threshold, computer 34 accordingly determines that the sampled ion voltage signal is excessively rough. Otherwise, computer 34 determines that the sampled ion voltage signal is sufficiently smooth.

In one embodiment, computer 34 is responsive to a determination that the sampled ion voltage is excessively rough to provide a fueling correction signal to computer 26 via signal path 52. Computer 26 is responsive to the fueling command correction signal to alter the fueling command signal provided to fueling system 56 via signal path 58 to thereby decrease the amount of fuel supplied to the engine 14. Preferably, computer 34 again keeps track of the number of firing cycles (number of firing command signals received at the trigger input T thereof), and provides the fueling command correction signal during the first firing cycle that the excessively rough ion voltage signal condition is detected. During the following firing cycle (i.e. after the fueling command signal has been corrected as just described), computer 34 again makes a determination of whether the sampled ion voltage is excessively rough. If so, computer 34 is operable to provide an ignition timing correction signal to computer 26 via signal path 54. Computer 26 is responsive to the ignition timing correction signal to alter the firing command signal provided to the ignition control circuit 24 via signal path 28 to thereby retard the time at which ignition control circuit 24 energizes the primary coil 14 as described hereinabove. During the following firing cycle (i.e. after both the fueling command signal and the firing command signal have been corrected as just described), computer 34 again makes a determination of whether the ion voltage signal is excessively rough. If so, computer 34 is operable to provide a spark energy correction signal to ignition control circuit 24 via signal path 48. Ignition control circuit 24 is responsive to the spark energy correction signal to reduce the spark energy, as described hereinabove, by suitably altering the duration and/or number of firing command signals provided by computer 26 on signal path 28.

Computer 34 is alternatively operable to process the ion voltage signal and perform a roughness analysis by comparing the ion voltage signal 102 with a predefined ion voltage waveform stored in memory, in a similar manner to the techniques described with respect to FIGS. 2A–2G. In other words, computer 34 may alternatively be operable to perform a signature analysis technique with respect to the sensed ion voltage signal and determine therefrom a roughness value of the portion 104 of the ion voltage signal 102. For example, if computer 34 determines that the sensed ion voltage signal exceeds the predefined ion voltage signal waveform by a first threshold amount for the signal portion 104, then subroutine B of FIG. 6B may be performed.

Figure 5A:
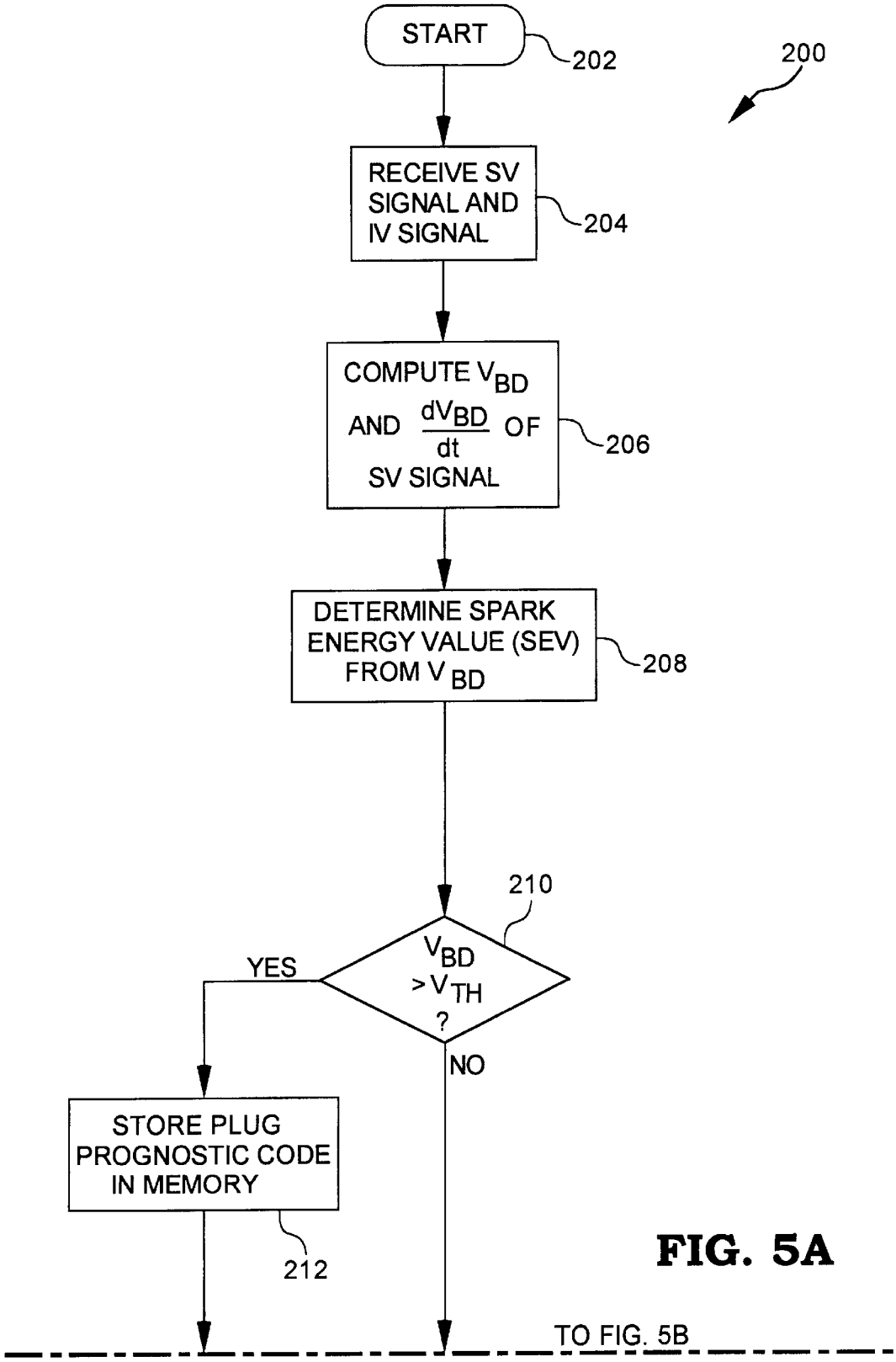
FIG. 5 is composed of FIGS. 5A–5C and is a flowchart illustrating one embodiment of a software algorithm executable by the computer of FIG. 1 for diagnosing and controlling the ignition system of FIG. 1, in accordance with another aspect of the present invention.
Figure 5B:
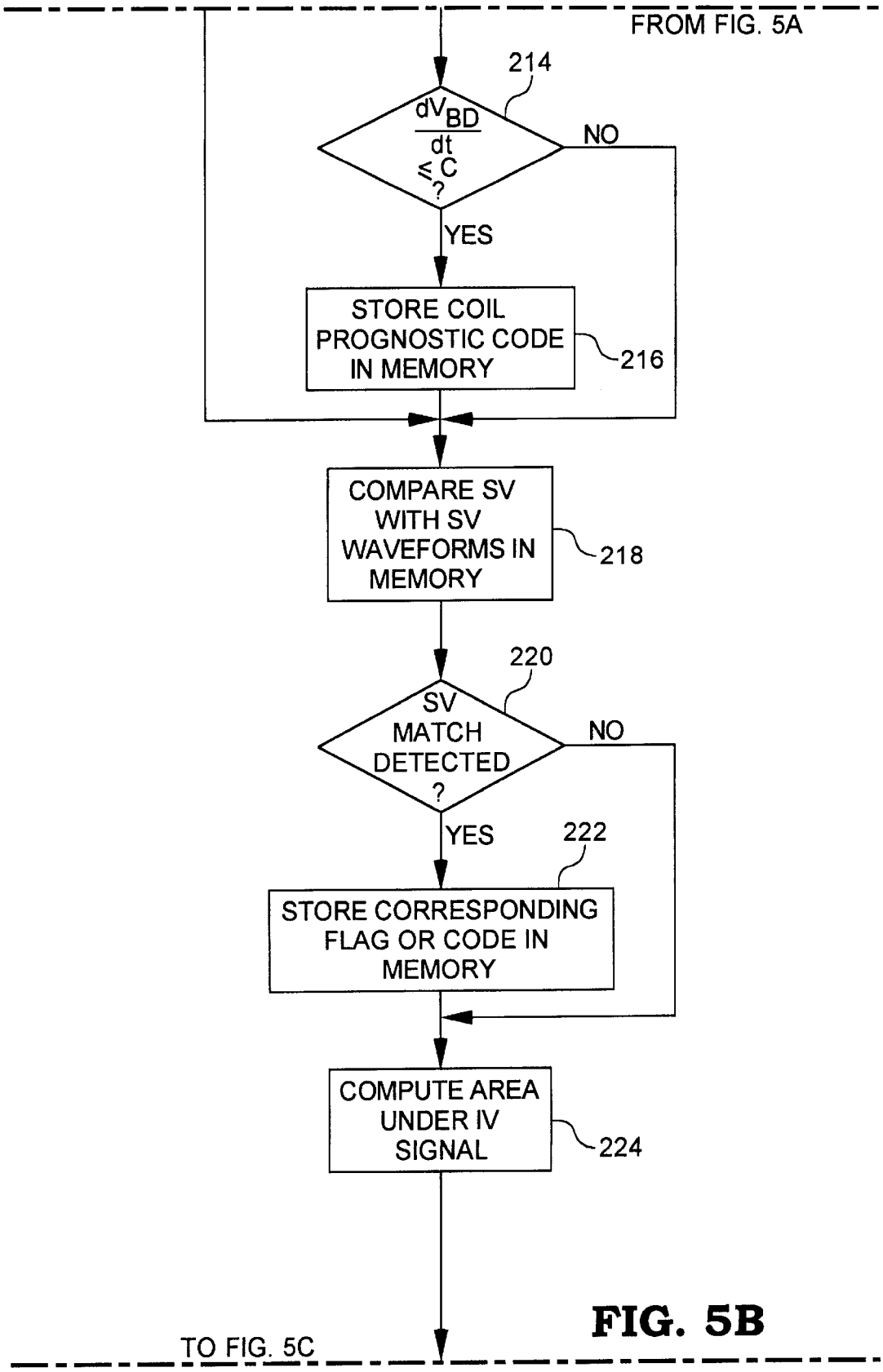
Figure 5C:
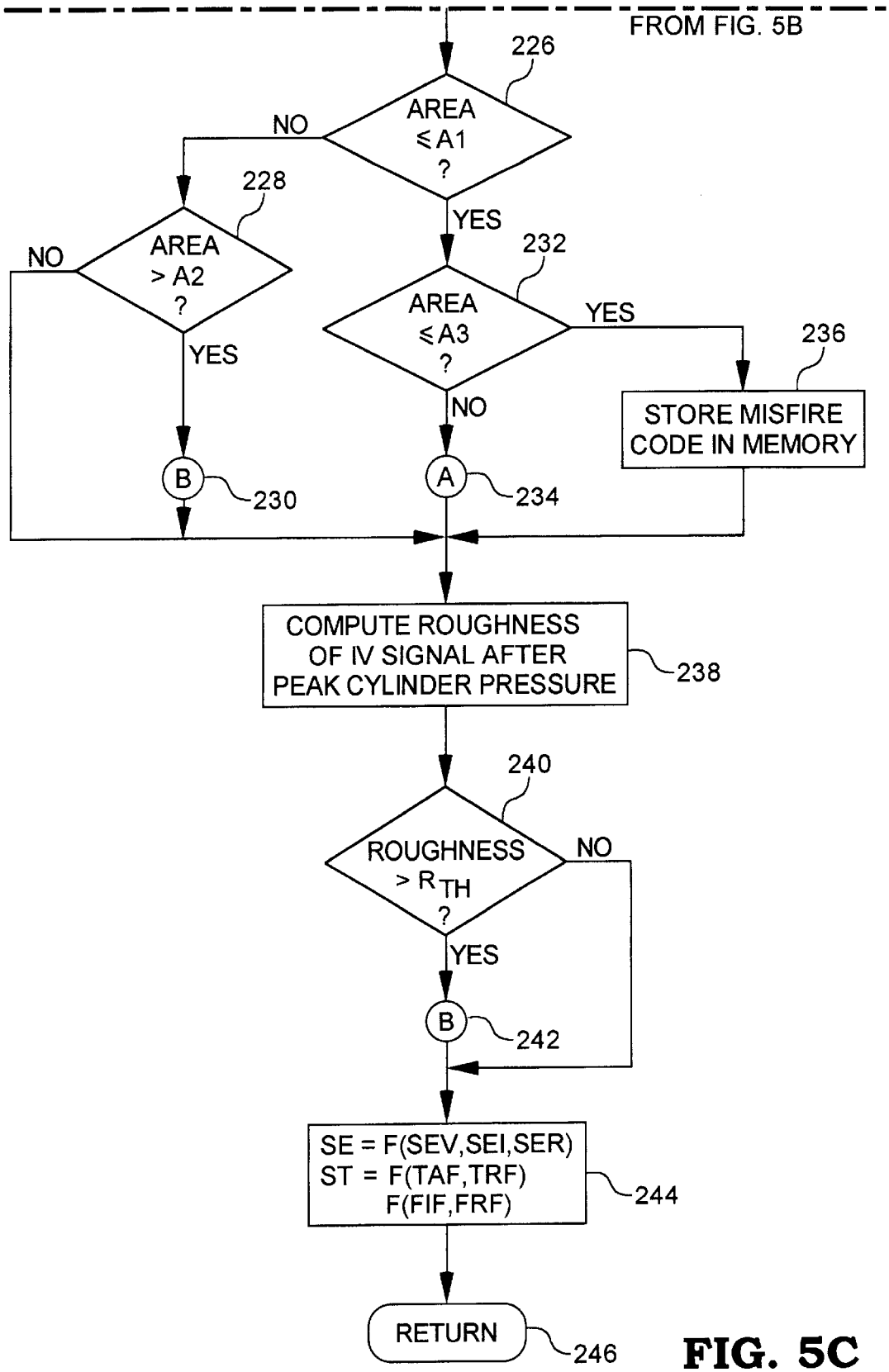

Referring now to FIGS. 5A–5C, a flowchart is shown illustrating one embodiment of a software algorithm 200, preferably executable by computer 34 of FIG. 1, for implementing the concepts of the present invention. Algorithm 200 begins at step 202, and at step 204, computer 34 receives (samples) the spark voltage signal provided by sensor 30 as well as the ion voltage signal provided by sensor 38. As described hereinabove, computer 34 is preferably triggered to samples such voltages by the firing command signal provided by computer 26 on signal path 28. In any case, algorithm execution continues from step 204 at step 206 where computer 34 determines the breakdown voltage $V_{BD}$, which corresponds to peak value of a corresponding voltage peak of the spark voltage signal (e.g. voltage peak 72 of FIG. 2A), according to known techniques, and computes the slope of the voltage peak about the peak value (i.e. $dV_{BD}/dt$), also in accordance with known techniques. Thereafter at step 208, computer 34 is operable to compute a spark energy value (SEV), preferably in accordance with equations (1)–(4) described hereinabove.

Thereafter at step 210, computer 34 is operable to compare $V_{BD}$ with a threshold voltage $V_{TH}$. If $V_{BD}$ is less than or equal to $V_{TH}$, algorithm execution continues at step 214. If, on the other hand, $V_{BD}$ is greater than $V_{TH}$ at step 210, algorithm execution continues at step 212 where computer 34 produces a plug diagnostic code which is stored within memory 35 or 27 as described hereinabove. Thereafter, algorithm execution continues at step 218.

At step 214, computer 34 has determined that $V_{BD}$ is less than or equal to $V_{TH}$, and computer 34 accordingly determines a slope of the voltage peak about the breakdown voltage $V_{BD}$, preferably by differentiating the sampled spark voltage signal about $V_{BD}$, and compares this slope with a predefined slope threshold C as described hereinabove. If the slope of the sampled spark voltage signal about $V_{BD}$ is greater than C, algorithm execution continues at step 218. If, however, computer 34 determines that the slope of sampled spark voltage signal about $V_{BD}$ is less than C, algorithm execution continues at step 216 where computer 34 produces a coil diagnostic code which is stored within memory 35 or 27 as described hereinabove. Algorithm execution continues from step 216 at step 218.

At step 218, computer 34 is operable to compare the sampled spark voltage signal with the number of spark voltage waveforms stored in memory 35 as described hereinabove. Thereafter at step 220, computer 34 determines whether the sampled spark voltage waveform matches any of the spark voltage waveforms stored in memory 35. If no matches are determined, algorithm execution continues at step 224. If, on the other hand, computer 34 determines at step 220 that the sampled spark voltage waveform matches one of the spark voltage waveforms stored in memory 35, algorithm execution continues at step 222 where a corresponding flag or code is stored within memory as described hereinabove. Thereafter, algorithm execution continues at step 224.

At step 224, computer 34 is operable to compute the area under the sampled ion voltage signal as described with respect to FIG. 4A. Preferably, computer 34 includes an integrator operable to perform such a computation, although the present invention contemplates that computer 34 may use any known technique for computing or estimating the area under the sampled ion voltage signal. In any case, algorithm execution continues from step 224 at step 226 where computer 34 compares the area under the sampled ion voltage signal with a first area boundary A1, preferably a lower area boundary as described above. If the area under the sampled ion voltage signal is greater than A1, algorithm execution continues at step 228 where computer 34 compares the area under the sampled ion voltage signal with a second area boundary A2, preferably an upper area boundary as described above. If the area under the sampled ion voltage signal is less than or equal to A2 at step 228, algorithm execution continues at step 238. If, however, the area under the sampled ion voltage signal is greater than A2 at step 228, algorithm execution continues at step 230 where algorithm execution is transferred to subroutine B which will be described more fully hereinafter with respect to FIG. 6B. Upon returning from subroutine B, step 230 advances to step 238.

If, at step 226, computer 34 determines that the area under the sampled ion voltage signal is greater than A1, algorithm execution continues at step 232 where computer 34 compares the area under the sampled ion voltage signal with a third area boundary A3, preferably a misfire area boundary as described hereinabove. If, at step 232, computer 34 determines that the area under the sampled ion voltage signal is greater than A3, algorithm execution continues at step 234 where algorithm execution is transferred to subroutine A which will be more fully described hereinafter with respect to FIG. 6A. Upon returning from subroutine A, step 234 advances to step 238. If, at step 232, computer 34 determines that the area under the sampled ion voltage signal is less than or equal to A3, algorithm execution continues at step 236 where a corresponding misfire code is stored in an appropriate memory as described hereinabove. Algorithm execution continues therefrom at step 238. It is to be understood, however, that steps 224–236 may be replaced with steps for conducting a combustion quality analysis according to a signature analysis technique as described hereinabove. Those skilled in the art of software programming will recognize that software coding of such steps is well within the skill of an ordinary software programmer and need not be further described herein.

At step 238, computer 34 is operable to determine a roughness value for the sampled ion voltage signal, preferably during a time span beginning coincident with a point in the firing cycle corresponding to peak cylinder pressure, as described hereinabove. Thereafter at step 240, computer 34 is operable to compare the roughness value determined in step 238 with a roughness threshold value $R_{TH}$. If, at step 240, the roughness value determined at step 238 is greater than $R_{TH}$, algorithm execution continues at step 242 where algorithm execution is transferred to subroutine B of FIG. 6B. Algorithm execution continues from step 242, and from the "NO" branch of step 240, to step 244. It is to be understood that the roughness analysis of step 238 may be conducted in accordance with either of the techniques described hereinabove, or in accordance with any other similar known technique.

Figure 6A:
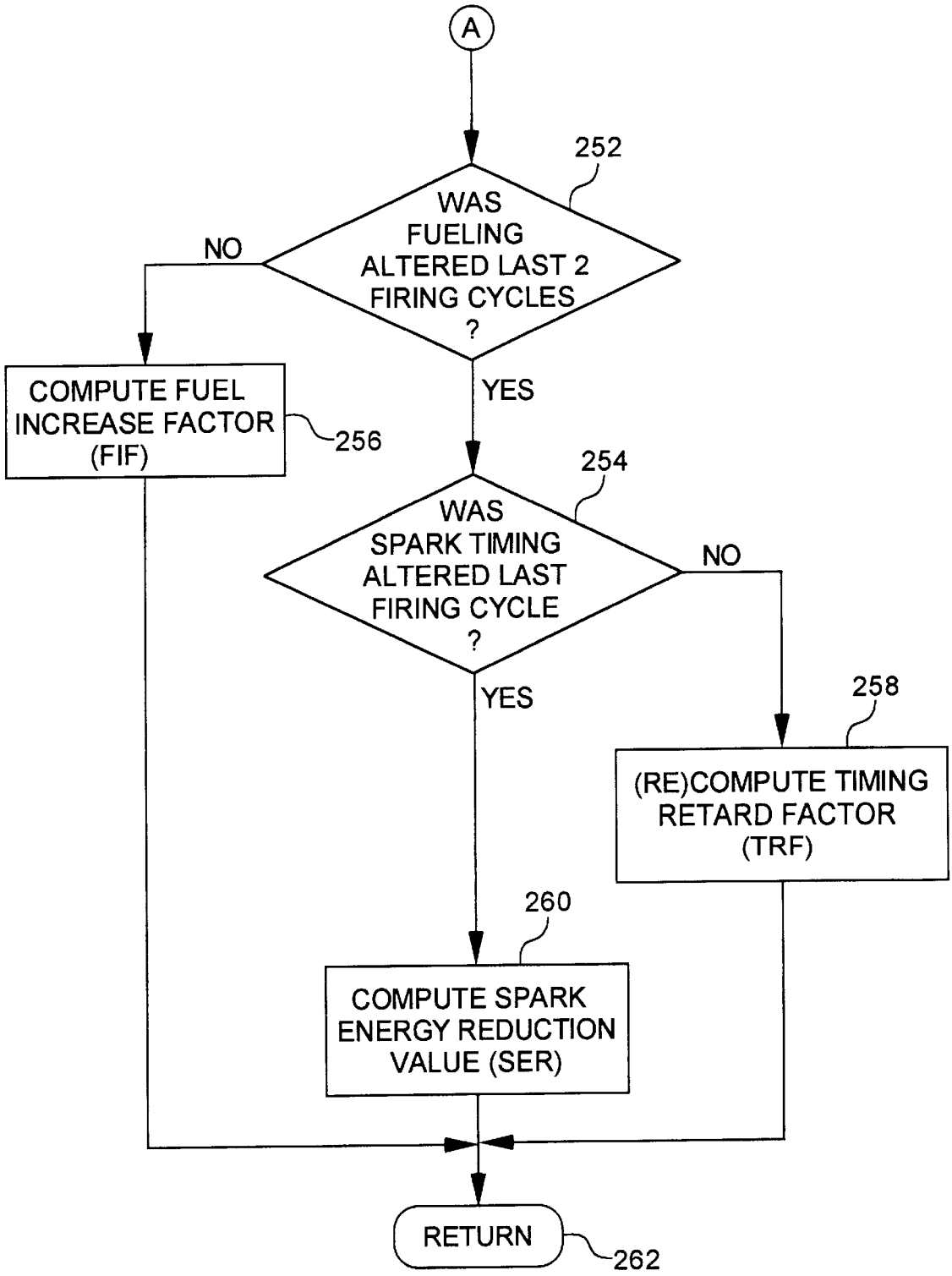
FIG. 6A is a flowchart illustrating one embodiment of a software algorithm executable by the computer of FIG. 1 for increasing fuel quantity, retarding spark timing and reducing spark energy.

Referring now to FIG. 6A, one embodiment of subroutine A, as called by step 234 of algorithm 200, is shown. Subroutine execution begins at step 252 where computer 34 determines, preferably from a count of the firing cycles as described hereinabove, whether the fueling command signal was altered within the previous two firing cycles. If not, subroutine execution continues at step 256 where computer 34 computes a fueling increase factor (FIF), and execution continues thereafter at step 262. If, at step 252, computer 34 determines that the fueling command signal was altered within the previous two firing cycles, subroutine execution continues at step 254 where computer 34 determines whether spark timing was altered (by altering the timing of the firing command signal as described hereinabove) during the previous firing cycle. If not, subroutine execution continues at step 258 where computer 34 is operable to compute (or recompute) a timing retard factor (TRF), and execution continues thereafter at step 262. If, at step 254, computer 34 determines that the spark timing was altered during the previous firing cycle, subroutine execution continues at step 260 where computer 34 computes a spark energy reduction value (SER). Subroutine execution continues thereafter at step 262 where subroutine A execution is returned to step 234 of algorithm 200.

Figure 6B:
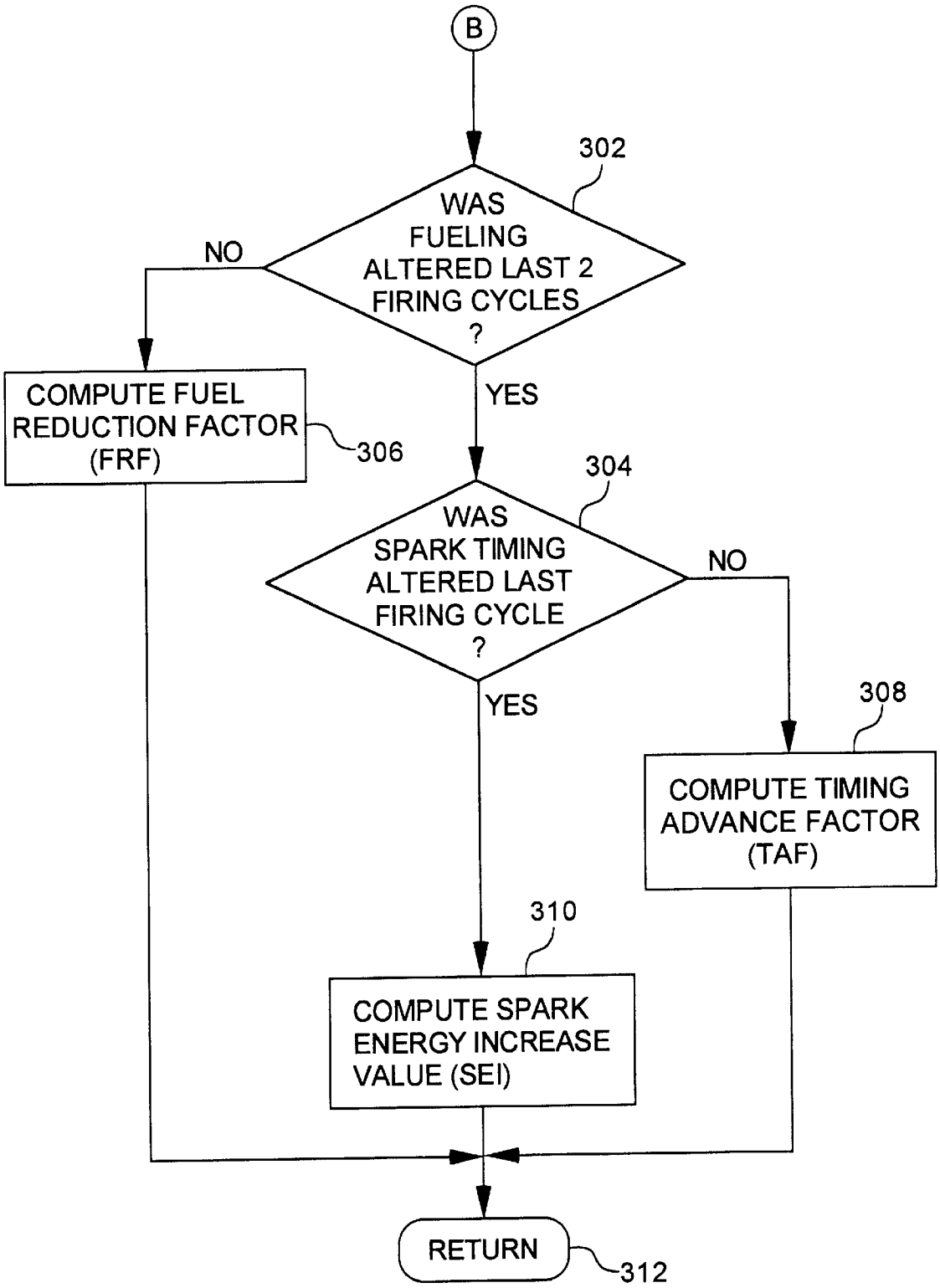
FIG. 6B is a flowchart illustrating one embodiment of a software algorithm executable by the computer of FIG. 1 for decreasing fuel quantity, advancing spark timing and increasing spark energy.

Referring now to FIG. 6B, one embodiment of subroutine B, as called by either of steps 230 or 242 of algorithm 200, is shown. Subroutine execution begins at step 302 where computer 34 determines, preferably from a count of the firing cycles as described hereinabove, whether the fueling command signal was altered within the previous two firing cycles. If not, subroutine execution continues at step 306 where computer 34 computes a fueling reduction factor (FIF), and execution continues thereafter at step 312. If, at step 302, computer 34 determines that the fueling command signal was altered within the previous two firing cycles, subroutine execution continues at step 304 where computer 34 determines whether spark timing was altered (by altering the timing of the firing command signal as described hereinabove) during the previous firing cycle. If not, subroutine execution continues at step 308 where computer 34 is operable to compute a timing advance factor (TAF), and execution continues thereafter at step 312. If, at step 304, computer 34 determines that the spark timing was altered during the previous firing cycle, subroutine execution continues at step 310 where computer 34 computes a spark energy increase value (SEI). Subroutine execution continues thereafter at step 312 where subroutine B execution is returned to an appropriate one of steps 230 or 242 of algorithm 200.

Returning again to algorithm 200 of FIG. 5C, computer 34 is operable at step 244 to compute a spark energy correction signal SE, which is a function of either SEV, SEI or SER, a spark timing correction signal ST, which is a function of TAF or TRF, and a fueling command correction signal FCC, which is a function of either FIF or FRF. Computer 34 is operable to then route the spark energy correction signal, the spark timing correction signal and the fueling command correction signal to an appropriate one of the ignition control circuit 24 and computer 26, wherein such circuits are operable to effectuate a corresponding spark energy correction, spark timing correction and/or fueling command correction, as described hereinabove. Algorithm execution continues from step 244 to step 246 where algorithm 200 is returned to its calling routine or alternatively looped back to step 202.

While the invention has been illustrated and described in detail in the foregoing drawings and description, the same is to be considered as illustrative and not restrictive in character, it being understood that only the preferred embodiment has been shown and described and that all changes and modifications that come within the spirit of the invention are desired to be protected.

What is claimed is:

1. Apparatus for predicting ignition system failures, comprising:

an ignition coil having a primary coil coupled to a secondary coil;

a spark plug connected to a high tension side and to a low tension side of said secondary coil and defining a spark gap therebetween;

an ignition control circuit connected to said primary coil and having an input responsive to a firing command to energize said primary coil to thereby induce a spark voltage in said high tension side of said secondary coil and a corresponding spark in said spark gap, said spark voltage exhibiting a voltage peak having a peak value corresponding to a breakdown voltage of said spark gap; and a first computer having an input coupled to said high tension side of said secondary coil for receiving said spark voltage, said first computer comparing said peak value of said voltage peak with a threshold value and producing a prognostic signal corresponding to a predefined ignition system failure mode if said peak value is greater than said threshold value.

2. The apparatus of claim 1 wherein said first computer includes a first memory, said first computer storing in said first memory an error code corresponding to said prognostic signal.

3. The apparatus of claim 1 further including a second computer having an input receiving said prognostic signal and a second memory, said second computer storing in said second memory an error code corresponding to said prognostic signal.

4. The apparatus of claim 1 further including a voltage sensor associated with said high tension side of said secondary coil, said voltage sensor sensing said spark voltage and providing a spark voltage signal corresponding thereto to said input of said second computer.

5. The apparatus of claim 4 wherein said voltage sensor is integral with said high tension side of said secondary coil.

6. Apparatus for predicting ignition system failures, comprising:

an ignition coil having a primary coil coupled to a secondary coil;

a spark plug connected to a high tension side and to a low tension side of said secondary coil and defining a spark gap therebetween;

an ignition control circuit connected to said primary coil and having an input responsive to a firing command to energize said primary coil to thereby induce a spark voltage in said high tension side of said secondary coil and a corresponding spark in said spark gap, said spark voltage exhibiting a voltage peak having a peak value corresponding to a breakdown voltage of said spark gap; and a first computer having an input coupled to said high tension side of said secondary coil for receiving said spark voltage, said first computer comparing a slope of said voltage peak about said peak value with a predefined slope value and producing a prognostic signal corresponding to a predefined ignition system failure mode if said slope of said peak value is less than said predefined slope value.

7. The apparatus of claim 6 wherein said first computer further includes means for computing a slope of said voltage peak about said peak value.

8. The apparatus of claim 7 wherein said means for computing a slope of said voltage peak about said peak value includes means for computing a first derivative of said voltage peak.

9. The apparatus of claim 6 wherein said first computer includes a first memory, said first computer storing in said first memory an error code corresponding to said prognostic signal.

10. The apparatus of claim 6 further including a second computer having an input receiving said prognostic signal and a second memory, said second computer storing in said second memory an error code corresponding to said prognostic signal.

11. The apparatus of claim 6 further including a voltage sensor associated with said high tension side of said secondary coil, said voltage sensor sensing said spark voltage and providing a spark voltage signal corresponding thereto to said input of said second computer.

12. The apparatus of claim 11 wherein said voltage sensor is integral with said high tension side of said secondary coil.

13. Apparatus for diagnosing ignition system failures, comprising:

an ignition coil having a primary coil coupled to a secondary coil;

a spark plug connected to a high tension side and to a low tension side of said secondary coil and defining a spark gap therebetween;

an ignition control circuit connected to said primary coil having an input responsive to a firing command to energize said primary coil to thereby induce a spark voltage in said high tension side of said secondary coil and a corresponding spark in said spark gap, said spark voltage exhibiting a voltage peak having a peak value corresponding to a breakdown voltage of said spark gap; and a first computer having an input coupled to said high tension side of said secondary coil for receiving said spark voltage, said first computer determining a spark energy of said spark as a function of said peak value of said voltage peak and providing a spark energy correction signal as a function of said spark energy, said ignition control circuit responsive to said spark energy correction signal to alter a spark energy of said spark induced in said spark gap.

14. The apparatus of claim 13 wherein said first computer is further operable to determine said spark energy of said spark as a function of a dimension of said spark gap.

15. The apparatus of claim 14 wherein said first computer is operable to determine an in-cylinder density value at a time of ignition as a function of said peak value of said voltage peak and a dimension of said spark gap;

and wherein said first computer is further operable to determine said spark energy as a function of said in-cylinder density value at a time of ignition.

16. The apparatus of claim 15 wherein said ignition coil forms part of an internal combustion engine defining a cylinder having said spark plug associated therewith;

and further including a second computer providing an air-fuel ratio value to said first computer, said air-fuel ratio value corresponding to an air-fuel ratio of fuel provided to said cylinder;

and wherein said first computer is further operable to determine said spark energy as a function of said air-fuel ratio value.

17. The apparatus of claim 13 wherein said spark plug includes a first electrode connected to said high tension side of said secondary coil and a second electrode connected to said low tension side of said secondary coil, said first and second electrodes defining said spark gap therebetween;

and wherein said ignition control circuit is responsive to said spark energy correction signal to alter the spark energy so as to produce a minimum spark energy necessary to achieve said breakdown voltage and thereby minimize erosion of said first and second spark plug electrodes.

18. The apparatus of claim 13 further including a voltage sensor associated with said high tension side of said secondary coil, said voltage sensor sensing said spark voltage and providing a spark voltage signal corresponding thereto to said input of said computer.

19. The apparatus of claim 18 wherein said voltage sensor is integral with said high tension side of said secondary coil.

20. The apparatus of claim 19 wherein said voltage sensor includes a capacitor having one end connected to said high tension side of said secondary coil and an opposite end providing said spark voltage signal.

* * * * *

UNITED STATES PATENT AND TRADEMARK OFFICE

CERTIFICATE OF CORRECTION

PATENT NO : 6,085,144
DATED : July 4, 2000
INVENTOR(S) : Luigi P. Tozzi

It is certified that error appears in the above-identified patent and that said Letters Patent are hereby corrected as shown below:

In column 17, line 37, delete "t," and insert --$t_1$,--.

Signed and Sealed this

Third Day of April, 2001

*Attest:*

Nicholas P. Godici

NICHOLAS P. GODICI

*Attesting Officer*

*Acting Director of the United States Patent and Trademark Office*